US010661924B2

(12) United States Patent
Andreotti et al.

(10) Patent No.: US 10,661,924 B2
(45) Date of Patent: May 26, 2020

(54) PACKAGING UNIT FOR PRODUCING SEALED PACKAGES CONTAINING A POURABLE FOOD PRODUCT FROM A TUBE OF PACKAGING MATERIAL

(71) Applicant: Tetra Laval Holdings & Finance S.A., Pully (CH)

(72) Inventors: Stefano Andreotti, Modena (IT); Ivan Orsini, Formigine (IT); Marco Poppi, Modena (IT); Matteo Galloni, Modena (IT); Nicola Spano', Castelfranco Emilia (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 16/092,640

(22) PCT Filed: Apr. 12, 2017

(86) PCT No.: PCT/EP2017/058788
§ 371 (c)(1),
(2) Date: Oct. 10, 2018

(87) PCT Pub. No.: WO2017/190928
PCT Pub. Date: Nov. 9, 2017

(65) Prior Publication Data

US 2019/0161219 A1 May 30, 2019

(30) Foreign Application Priority Data

May 6, 2016 (EP) ..... 16168543

(51) Int. Cl.
*B65B 1/02* (2006.01)
*B65B 9/10* (2006.01)
(Continued)

(52) U.S. Cl.
CPC ..... *B65B 9/2049* (2013.01); *B65B 1/02* (2013.01); *B65B 51/303* (2013.01)

(58) Field of Classification Search
CPC ... B65B 9/2049; B65B 9/2035; B65B 9/2042; B65B 9/2014; B65B 1/02; B65B 9/10; B65B 9/20; B65B 1/30
(Continued)

(56) References Cited

U.S. PATENT DOCUMENTS 2,915,866 A * 12/1959 Bartlo ..... B29C 66/43 53/526
4,079,662 A * 3/1978 Puccetti ..... B65B 9/2014 493/203
(Continued)

FOREIGN PATENT DOCUMENTS

EP 1266832 A1 * 12/2002 ..... B65B 41/18
EP 1 795 447 6/2007

OTHER PUBLICATIONS

International Search Report and Written Opinion in corresponding PCT Application No. PCT/EP2017/058788 dated May 23, 2017 (8 pages).

*Primary Examiner* — Praachi M Pathak
(74) *Attorney, Agent, or Firm* — Finnegan, Henderson, Farabow, Garrett & Dunner, LLP

(57) ABSTRACT

A packaging unit for producing sealed packages from a tube of packaging material advanced along a first axis includes: at least two jaws arranged on opposite sides of the first axis and movable between a closed position, in which they grip and seal the tube and an open position, in which they are detached from the tube; at least two forming members supported by the respective jaws in a movable manner between a first operating position, in which, in relation to the position of the jaws, they have the maximum distance from one another, and a second operating position, in which they
(Continued)

mate with one another and an actuator to produce movement of the forming members; the actuator includes at least one mover connected to both forming members and selectively activated to perform opposite strokes, along which the mover itself produces the movement of each forming members.

12 Claims, 8 Drawing Sheets

(51) Int. Cl.
*B65B 9/20* (2012.01)
*B65B 1/30* (2006.01)
*B65B 51/30* (2006.01)

(58) Field of Classification Search
USPC ..... 53/551
See application file for complete search history.

(56) References Cited

U.S. PATENT DOCUMENTS 4,563,862 A * 1/1986 McElvy ..... B29C 66/8491 53/552
4,580,392 A * 4/1986 Lagerstedt ..... B65B 9/207 53/451
5,125,213 A * 6/1992 Focke ..... B65B 1/22 53/437
5,155,980 A * 10/1992 Mansson ..... B65B 9/207 53/551
5,203,145 A * 4/1993 Kammler ..... B65B 9/207 53/552
5,540,035 A * 7/1996 Plahm ..... B65B 9/20 53/450
5,881,539 A * 3/1999 Fukuda ..... B65B 9/213 53/374.5
6,038,838 A * 3/2000 Fontanazzi ..... B65B 51/30 53/551
6,112,498 A * 9/2000 Hansson ..... B65B 51/30 53/551
6,119,438 A * 9/2000 Bacon ..... B65B 9/20 53/451
6,138,442 A * 10/2000 Howard ..... B65B 51/30 53/373.7
6,260,336 B1 * 7/2001 Motomura ..... B29C 65/3656 53/551
6,526,733 B1 * 3/2003 Schellenberg ..... B65B 9/2042 493/11
6,543,205 B1 * 4/2003 Faskhoody ..... B65B 51/30 53/371.5
7,748,201 B2 * 7/2010 Poppi ..... B65B 9/2049 53/374.5
8,919,081 B2 * 12/2014 Andreotti ..... B29C 65/18 53/451
9,284,078 B2 * 3/2016 Orsini ..... B29C 65/08
10,029,814 B2 * 7/2018 Galata' ..... B65B 61/24
2005/0172574 A1 * 8/2005 Paradisi ..... B29C 66/4312 53/374.2
2009/0019819 A1 * 1/2009 Karlsson ..... B29C 65/3656 53/551
2010/0205911 A1 * 8/2010 Fontanazzi ..... B65B 9/2049 53/452
2011/0120059 A1 * 5/2011 Andreotti ..... B29C 65/18 53/451
2013/0227918 A1 * 9/2013 Paradisi ..... B65B 9/12 53/551
2015/0135649 A1 5/2015 Orsini et al.

* cited by examiner

PACKAGING UNIT FOR PRODUCING SEALED PACKAGES CONTAINING A POURABLE FOOD PRODUCT FROM A TUBE OF PACKAGING MATERIAL

CROSS-REFERENCE TO RELATED PATENT APPLICATIONS

This is a National Phase of International Application No. PCT/EP2017/058788, filed Apr. 12, 2017, which claims the benefit of European Application No. 16168543.3 filed May 6, 2016. The entire contents of the above-referenced applications are expressly incorporated herein by reference.

TECHNICAL FIELD

The present invention relates to a packaging unit for producing sealed packages containing a pourable food product from a tube of packaging material.

BACKGROUND OF INVENTION

Many pourable food products, such as fruit juice, pasteurized or UHT (ultra-high-temperature treated) milk, wine, tomato sauce, etc., are sold in packages made of a sterilized packaging material.

A typical example of this type of package is the parallelepiped-shaped package for liquid or pourable food products known as Tetra Brik Aseptic (registered trademark), which is made by folding and sealing a laminated web packaging material. The laminated packaging material comprises layers of fibrous material, e.g. paper, covered on both sides with thermoplastic material, e.g. polyethylene. In the case of packages for long-storage products (such as UHT milk), the side of the packaging material eventually contacting the food product also has a layer of barrier material, e.g. aluminium foil or ethyl vinyl alcohol (EVOH) film, which in turn is covered with a layer of thermoplastic material.

As known, packages of this sort, provided or not with the layer of barrier material, are produced on fully automatic packaging machines, on which a continuous tube is formed from the web-fed packaging material; the web of packaging material is sterilized on the packaging machine, e.g. by applying a chemical sterilizing agent, such as a hydrogen peroxide solution; once sterilization is completed, the sterilizing agent is removed, e.g. vaporized by heating, from the surfaces of the packaging material.

The sterilized web of packaging material is maintained in a closed, sterile environment and is folded into a cylinder and sealed longitudinally to form a tube.

The tube is fed in a vertical direction parallel to its axis, and is filled continuously with the sterilized or sterile-processed food product.

The packaging unit interacts with the tube to heat seal equally spaced cross sections of the tube and form pillow packs connected to the tube by transverse sealing bands.

More specifically, the packaging unit comprises two forming assemblies movable along respective guides and which interact cyclically and successively with the tube to heat seal the packaging material of the tube.

Each forming assembly comprises a slide, movable back and forth along the respective guide, and two jaws hinged at the bottom to the respective slide and movable between a closed position, in which they cooperate with the tube to heat seal it at a cross section thereof, and an open position, in which they are detached from the tube.

More specifically, the jaws of each forming assembly are moved between the open and the closed position by respective cams.

The forming assemblies operate a half-period out of phase: one forming assembly moves up, with its jaws open, while the other forming assembly moves down, with its jaws closed, to avoid collision and interference between the assemblies.

The jaws of each forming assembly are fitted with respective sealing members cooperating on opposite sides with the tube, and defined, for example, by a heating member and by a counter-pressure member configured to provide mechanical support to grip the tube with the necessary pressure.

Each forming assembly also comprises a pair of forming members in the form of half-shells, which are hinged to the respective jaws and interact mutually to fold the tube between two consecutive sealed sections and define the volume of the package being formed.

The forming members of each forming assembly are movable cyclically between a first operating position, in which, in relation to the position of the respective jaws, the forming members have the maximum distance from one another, and a second operating position, in which, in relation to the closed position of the respective jaws, the forming members mate with one another and cooperate with the tube to define the shape and volume of the package being formed.

The forming members are usually spring-loaded elastically into the first operating position and have respective rollers which cooperate with relative cams designed to close the forming members about the tube when the relative forming assembly is in a predetermined position.

Though of excellent performance in general, packaging units of the type described above still leave room for further improvement.

In particular, at certain travelling speeds of the forming assemblies, the forming members reaching the first operating position produces shock, which dynamically stresses the packaging unit and which can only be reduced—by appropriately adjusting the stiffness of the springs and the mass of the moving parts—at a given travelling speed of the slide, thus limiting output and flexibility of the packaging unit.

To solve this kind of problem, EP-A-1795447 proposes a packaging unit also including retaining means configured to cooperate with the forming members of each forming assembly during their strokes towards the first operating position in order to oppose the elastic force acting on the forming members themselves and to reduce dynamic stress at the end of such strokes.

The retaining means of each forming assembly comprise a first member carried by the slide and two second members carried by the respective forming members and each cooperating in sliding manner with the first member to reduce the elastic thrust exerted on the forming members themselves during their strokes towards the first operating position.

In one embodiment disclosed in EP-A-1795447, the first member is defined by a piston of a variable-length actuator and the second members are defined by respective operating arms protruding from the respective forming members and cooperating in sliding manner with such piston.

In particular, interaction between the piston of the actuator and the operating arms is used to reduce the elastic force on the forming members during their strokes towards the first operating position as well as to cause the forming members to perform opposite strokes towards the second operating position.

Though offering a more flexible solution to the problems posed by the use of cams to control movement of the forming members, packaging units of the type disclosed in the above-described embodiment of EP-A-1795447 still leave room for further improvement.

In particular, due to the fact that in the open position of the jaws of each forming assembly, the relative actuator looses contact with the operating arms of the forming members, the latter have to be moved to the first operating position before the respective jaws leave the tube.

This necessarily imposes a constraint to the work cycle of the forming members.

Moreover, the entire upward movement of the slide of each forming assembly with the jaws opened (i.e. the return stroke) has to be performed also with the forming members in the first operating position, only kept there by the respective springs. This means that no control of the position of the forming members can be performed in the return stroke and that such forming members may be subjected to undesired vibrations and dynamic stresses.

DISCLOSURE OF INVENTION

It is an object of the present invention to provide a packaging unit for producing sealed packages containing a pourable food product from a tube of packaging material, designed to eliminate the aforementioned drawbacks typically associated with known packaging units.

According to the present invention, there is provided a packaging unit as claimed in claim 1.

BRIEF DESCRIPTION OF THE DRAWINGS

A preferred, non-limiting embodiment of the present invention will be described by way of example with reference to the accompanying drawings, in which.

DETAILED DESCRIPTION OF PREFERRED EMBODIMENTS

Figure 1:
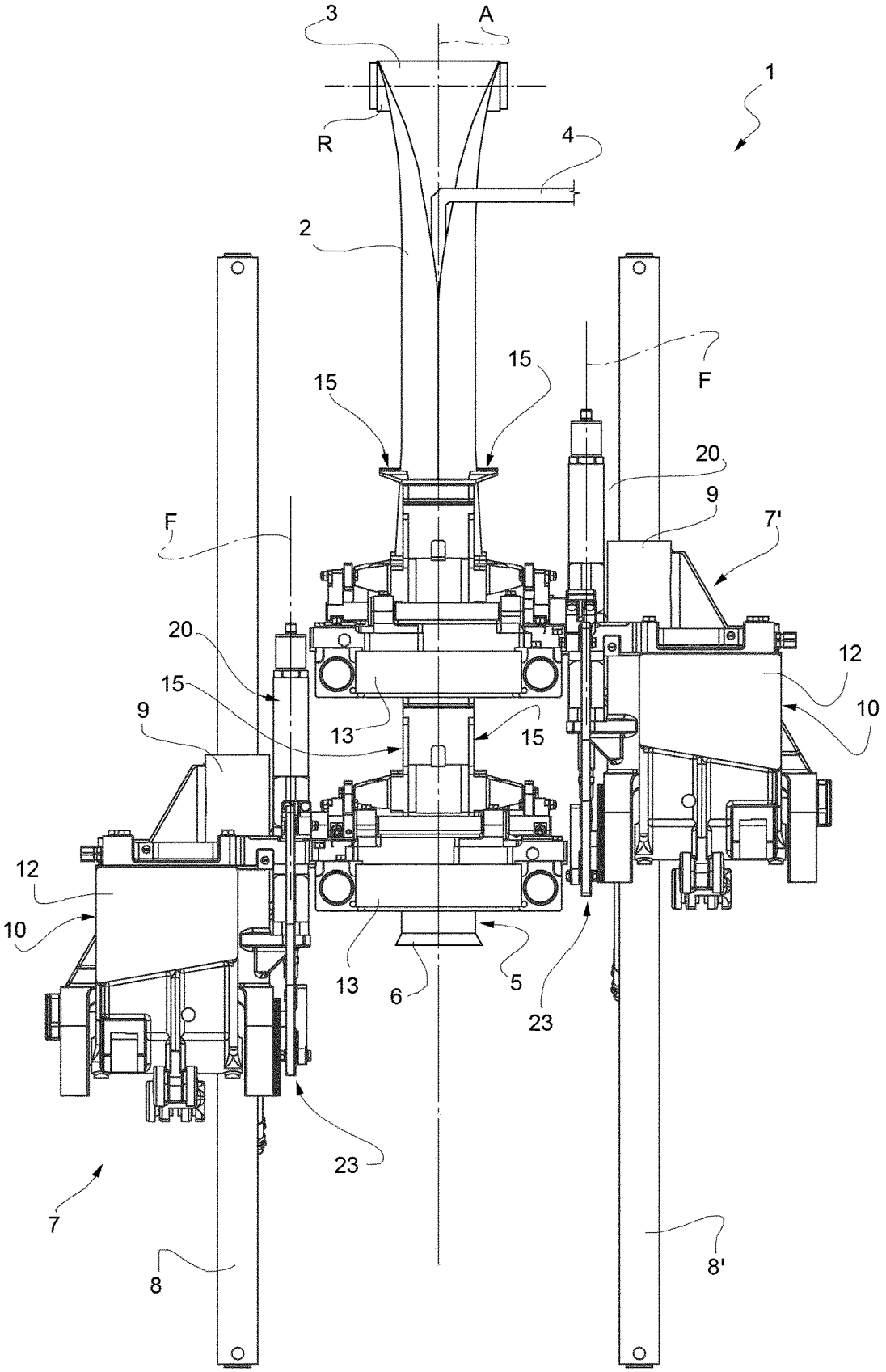
FIG. 1 shows a front view, with parts removed for clarity, of a packaging unit in accordance with the teachings of the present invention.

With reference to FIG. 1, number 1 indicates as a whole a packaging unit for producing sealed packages (not shown) containing a pourable food product, such as pasteurized milk or fruit juice, from a tube 2 of sheet packaging material advanced along an axis A, vertical in the embodiment shown.

The packaging material has a multilayer structure (not shown), and comprises a layer of fibrous material, normally paper, covered on both sides with respective layers of heat-seal plastic material, e.g. polyethylene. In the case of aseptic packages for long-storage products, such as UHT milk, the packaging material also comprises a layer of oxygen-barrier material, e.g. aluminium foil or ethyl vinyl alcohol (EVOH) film, which is superimposed on a layer of heat-seal plastic material, and is in turn covered with another layer of heat-seal plastic material eventually defining the inner face of the package contacting the food product.

In practice, the packaging material may comprise or not the layer of oxygen-barrier material.

Tube 2 is formed in known manner by longitudinally folding and sealing a web 3 of heat-sealable sheet material, is filled by a feed pipe 4 with the sterilized or sterile-processed food product, and is fed in known manner by one or more motorized rollers R to packaging unit 1.

Packaging unit 1 interacts with tube 2 to heat seal equally spaced cross sections thereof and to form a number of pillow packs 5 connected to the tube 2 itself by transverse sealing bands 6.

Packaging unit 1 comprises, in known manner, two forming assemblies 7, 7', which interact cyclically with tube 2 to advance the latter along a vertical path defined by axis A and to grip and heat seal equally spaced cross sections of the tube 2 itself extending perpendicular to the axis A; forming assemblies 7, 7' are arranged on opposite sides of axis A and move vertically along respective vertical cylindrical guides 8, 8', located symmetrically with respect to the axis A itself.

More specifically, forming assemblies 7, 7' move along guides 8, 8' from a bottom dead-centre position to a top dead-centre position, and vice versa, in an upward and downward movement respectively.

Since forming assemblies 7 and 7' are identical, only one (forming assembly 7) is described herein; identical or corresponding parts of forming assemblies 7, 7' are indicated in the accompanying drawings using the same reference numbers.

With particular reference to FIGS. 2 to 8, forming assembly 7 substantially comprises a supporting body in the form of a slide 9, running along respective guide 8, and two jaws 10, 11—defined, in the example shown, by respective L-shaped plates—hinged at the bottom to slide 9 about respective axes B, C, which, in use, are horizontal and perpendicular to axis A. Jaws 10, 11 are located on opposite sides of axis A and tube 2, and rotate about respective axes B, C between a closed position (FIGS. 2, and 4 to 8), in which they grip tube 2, and an open position (FIG. 3), in which they are detached from tube 2.

Figure 2:
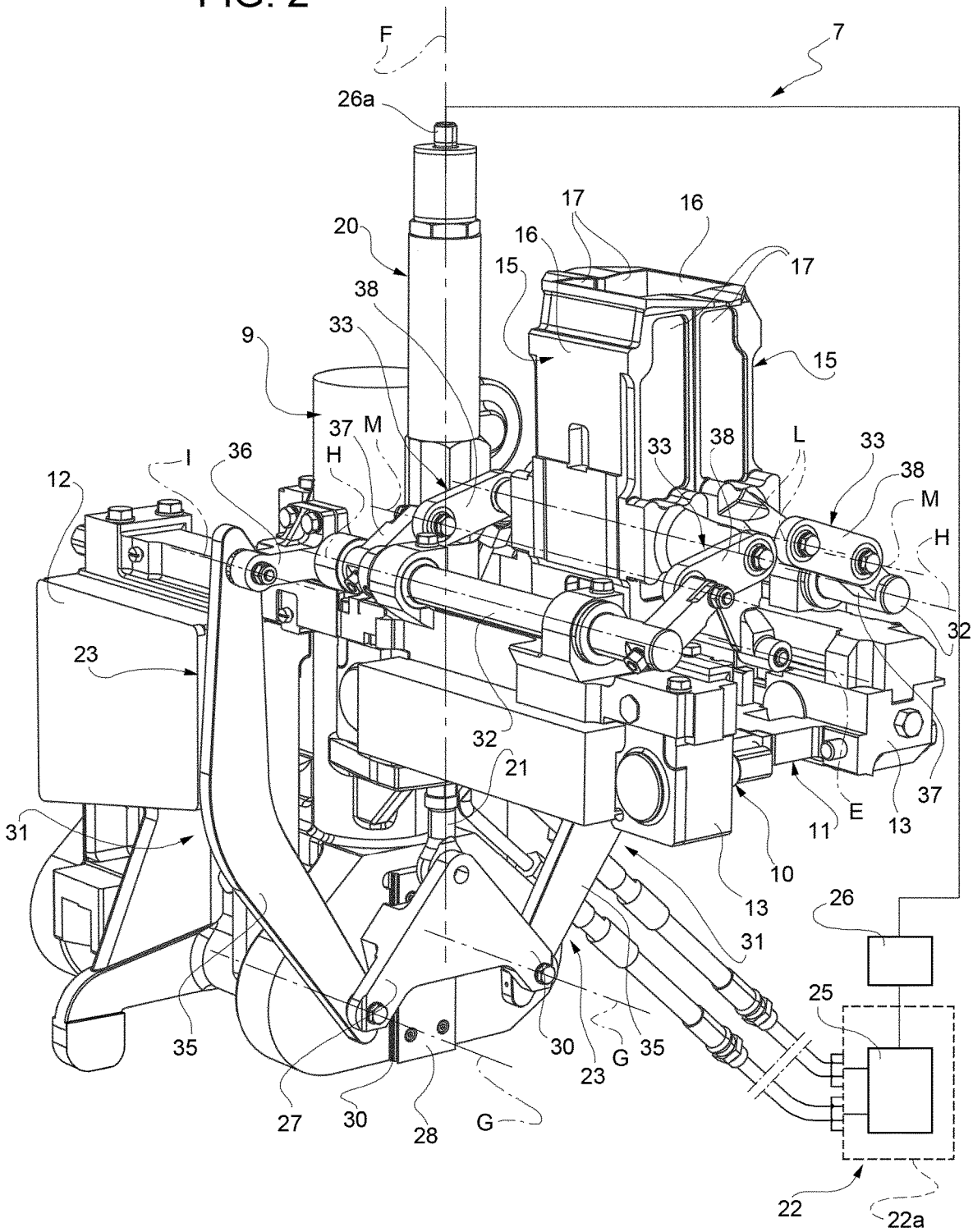
FIG. 2 shows a larger-scale perspective view, with parts removed for clarity, of a forming assembly of the FIG. 1 unit in a given operating condition.

More specifically, each jaw 10, 11 comprises a substantially quadrangular base portion 12, hinged at its bottom end to a bottom portion of slide 9, and an arm 13, which interacts with tube 2, is fixed to a top end of base portion 12 and extends perpendicular to axis A. As shown in FIGS. 1 and 2, each arm 13 protrudes from base portion 12 of the relative jaw 10, 11 towards a region of packaging unit 1 where tube 2 is advanced vertically.

Jaws 10, 11 are rotated in use in opposite directions and by equal angles about respective axes B, C in a known manner, not shown nor described as not being part of the present invention.

Forming assembly 7 also comprises a first retaining member and a second retaining member (known per se and not shown), which are carried by respective jaws 10, 11 and can be selectively coupled in the closed position of the jaws 10, 11 to maintain the jaws 10, 11 themselves firmly engaged when cooperating with tube 2.

Jaws 10, 11 therefore perform a linear vertical movement by virtue of the movement of slide 9 along guide 8, and an opening and closing movement with respect to tube 2 of packaging material by rotating about respective axes B, C, by which they are hinged to slide 9. The opening and closing movement is superimposed on the vertical, back and forth linear movement of slide 9.

The vertical movement and the opening and closing movement are controlled in a known manner, not shown nor described as not being part of the present invention.

Forming assemblies 7, 7' operate a half-period out of phase: forming assembly 7 moves up, with jaws 10, 11 open, at the same time as forming assembly 7' moves down, so that arms 13 of forming assembly 7' pass between, and so avoid interfering with, arms 13 of forming assembly 7.

Forming assembly 7 also comprises a sealing device—known and not shown in the drawings—to heat seal each cross section of tube 2 of packaging material gripped between relative jaws 10, 11.

The sealing device comprises a heating member, fitted to arm 13 of jaw 10 and interacting with tube 2, and a counter-pressure member, fitted to arm 13 of jaw 11 and cooperating with the heating member to grip and heat seal tube 2.

In particular, the heating member may be a mechanical-vibration generator or sonotrode, and the counter-pressure member may be an anvil cooperating in use with the sonotrode to heat the packaging material by ultrasonic vibrations.

In cases in which the packaging material includes a barrier layer defined by a sheet of electrically conducting material, e.g. aluminium, the heating member may be an electric inductor capable of inducing an electric current in the barrier layer itself so as to locally melt the layers of heat-seal plastic material and produce sealing thereof; the counter-pressure member may include one or more pressure pads.

With reference to the enclosed Figures, forming assembly 7 also comprises two forming members 15, configured as half-shells, facing each other and hinged to respective jaws 10, 11; forming members 15 are arranged on opposite sides of axis A and tube 2 and are supported by the respective jaws 10, 11 in a movable manner between a first operating position (FIGS. 3 and 4), in which, in relation to the position of the respective jaws 10, 11, the forming members 15 are placed at the maximum distance from one another, and a second operating position (FIGS. 1, 2, 5, 6, 7 and 8), in which, in relation to the closed position of the jaws 10, 11, the forming members 15 mate with one another and cooperate with tube 2 to define the volume of the package being formed between each two consecutive cross sections.

More specifically, forming members 15 are hinged to arms 13 of respective jaws 10, 11 about respective axes D, E parallel to axes B, C and orthogonal to axis A.

In practice, forming members 15 have respective rotary movements towards and away from one another about respective axes D, E.

Each forming member 15 has a C-shaped cross section open at the front. The forming members 15, following transverse sealing by jaws 10, 11, cooperate with each other to define a cavity, of given shape and volume, enclosing tube 2 into a rectangular-section configuration.

Each forming member 15 comprises a flat, rectangular rear wall 16, parallel to axes A, B, C, D, E, and two lateral walls 17 projecting perpendicularly from opposite lateral edges of rear wall 16; lateral walls 17 are also orthogonal to axes B, C, D, E.

As forming assembly 7 moves up and down, forming members 15 perform a work cycle comprising:

- a closing stroke (FIG. 4), in which forming members 15 move towards tube 2 from their open configurations to their closed configurations;
- a volume-control stroke (FIG. 5), in which forming members 15 cooperate with tube 2;
- a return stroke, in which forming members 15, following withdrawing movement of jaws 10, 11 from tube 2, are detached from the tube 2 itself; and
- an opening stroke, in which forming members 15 are moved from their closed configurations to their open configurations.

Forming assembly 7 further comprises at least one actuator 20 having a mover 21, which is always connected to both forming members 15 whatever is the position of the jaws 10, 11, and which is selectively activated to produce movement of the forming members 15 between the first operating position and the second operating position.

In particular, mover 21 is selectively activated to perform opposite strokes, along which it produces the movement of forming members 15 from their first operating position to their second operating position and vice versa without any additional spring member.

A control system 22 is also provided to control the strokes of mover 21 and to set in real time the corresponding timing of the strokes themselves.

In the preferred example shown in the enclosed Figures, actuator 20 is of linear type, is carried by slide 9 and extends along an axis F parallel to axis A. Mover 21 is linearly movable along axis F in opposite directions to produce the above-mentioned opposite strokes and is connected to both forming members 15 through respective linkages 23. Each linkage 23 transforms the linear movement of mover 21 along axis F into a rotary movement of the respective forming member 15 about the respective axis D, E.

As a possible alternative not shown, forming assembly 7 may also comprise two parallel actuators 20, each one connected to one respective forming member 15 through one respective linkage 23.

As a further possible alternative not shown, forming assembly 7 may also comprise one rotary actuator connected to both forming members 15 or two rotary actuators, each one connected to one respective forming member 15.

With reference to the enclosed Figures, actuator 20 is preferably of fluidic type and includes a housing 24 and a piston coupled in a sliding manner into housing 24 and defining mover 21.

Figure 3:
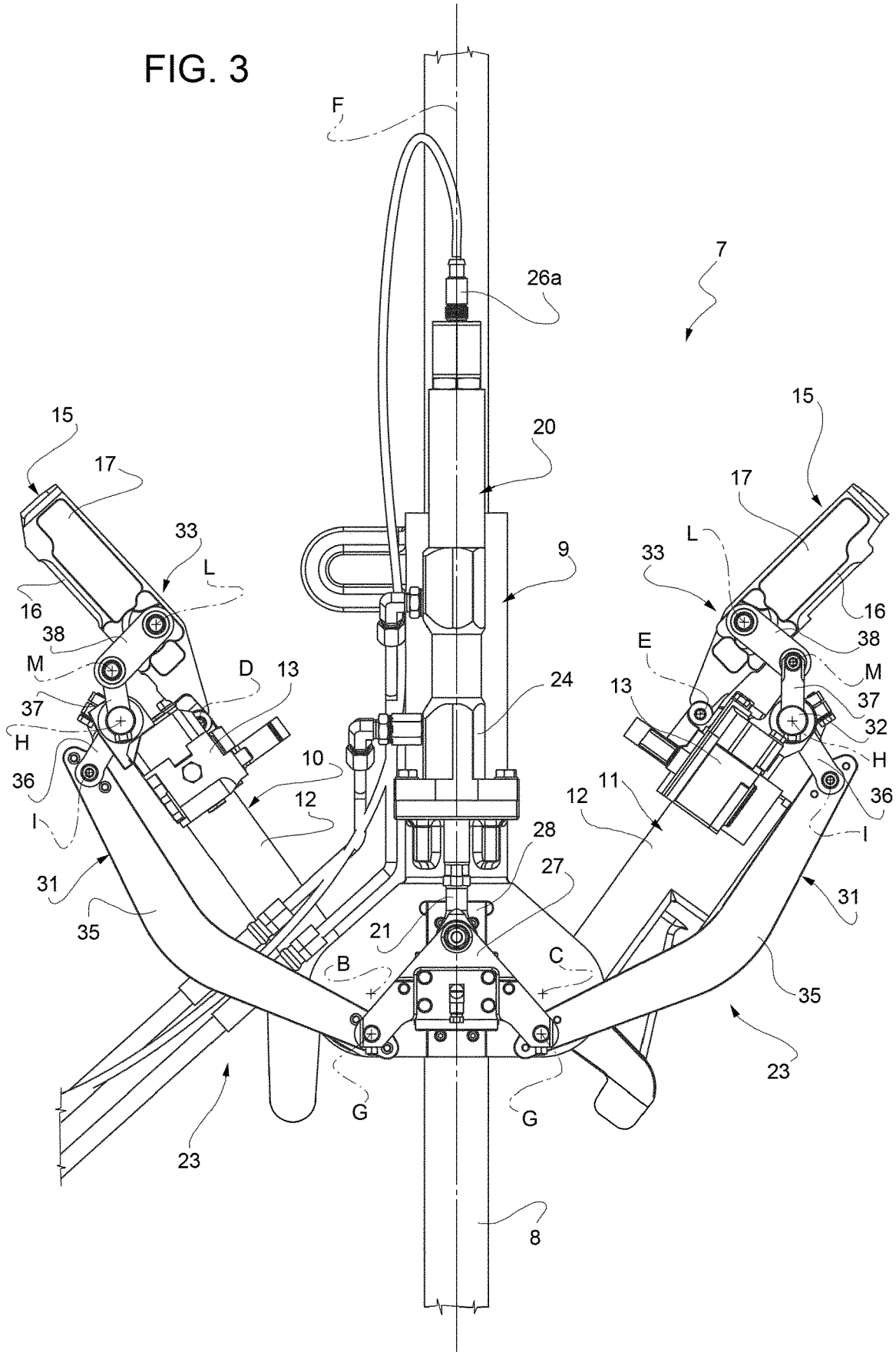
FIGS. 3 and 4 show respective side views of the forming assembly of FIG. 2 in further operating conditions.
Figure 4:
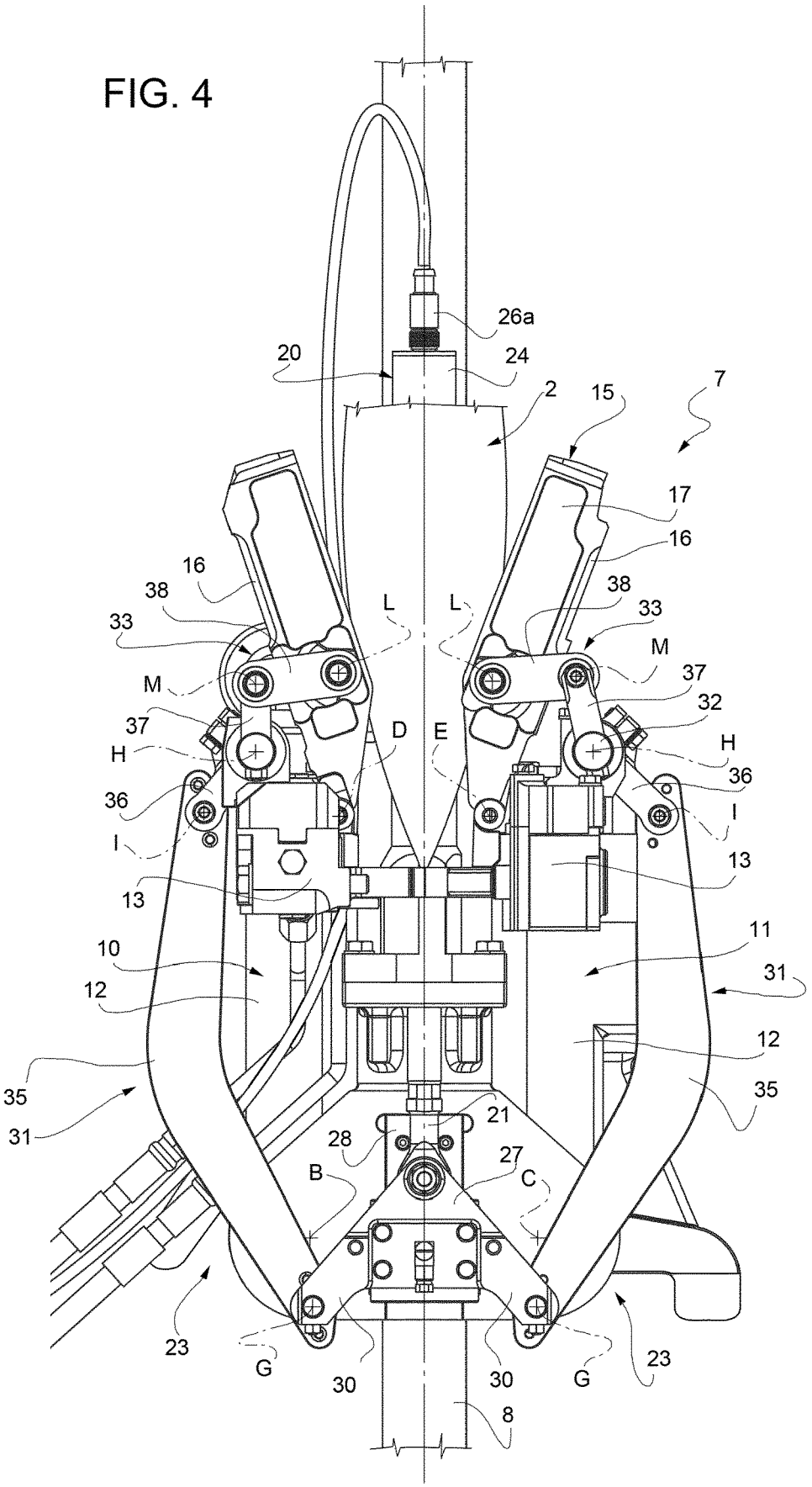
Figure 5:
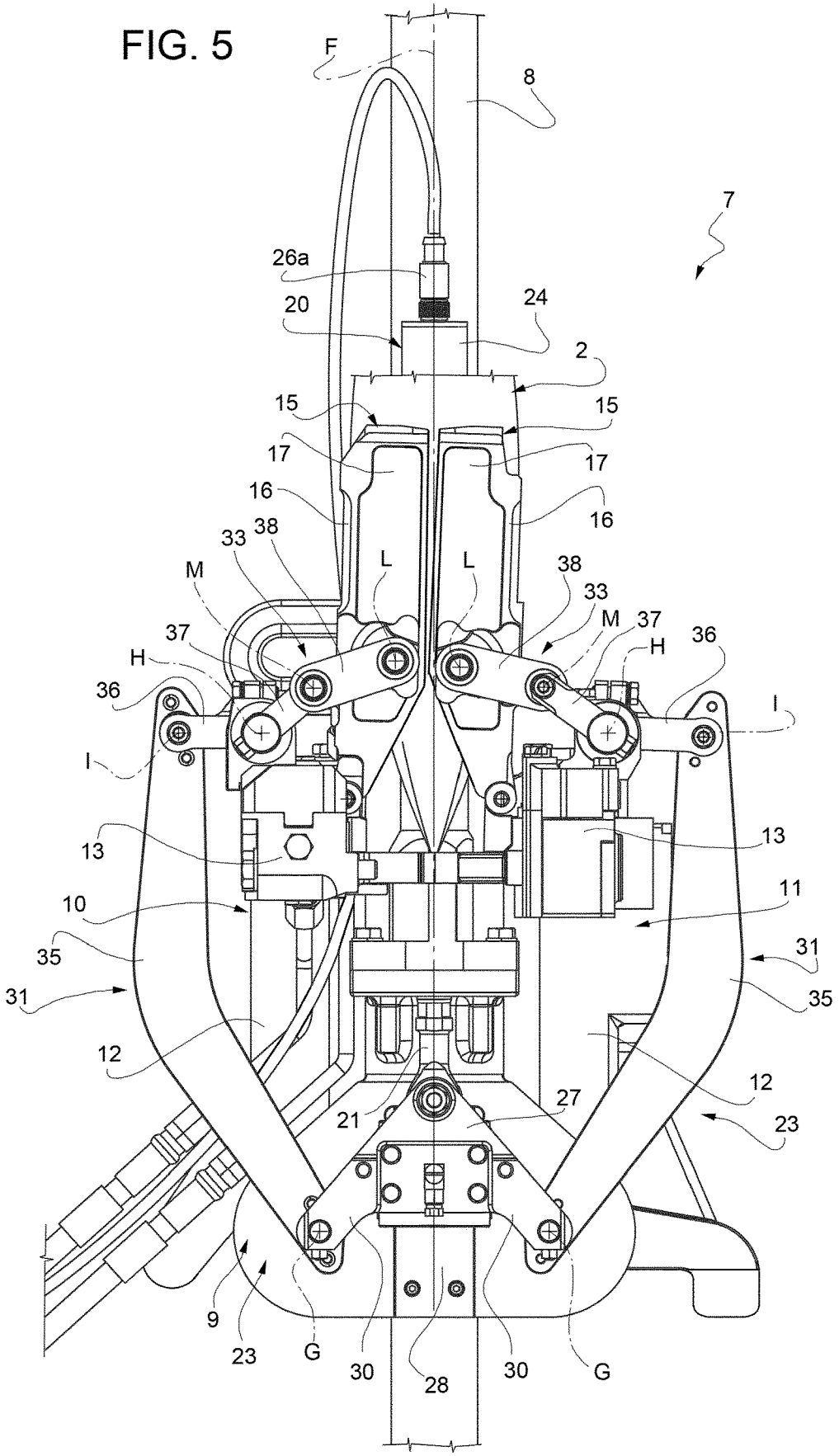
FIG. 5 shows a side view of the forming assembly of FIG. 2.
Figure 6:
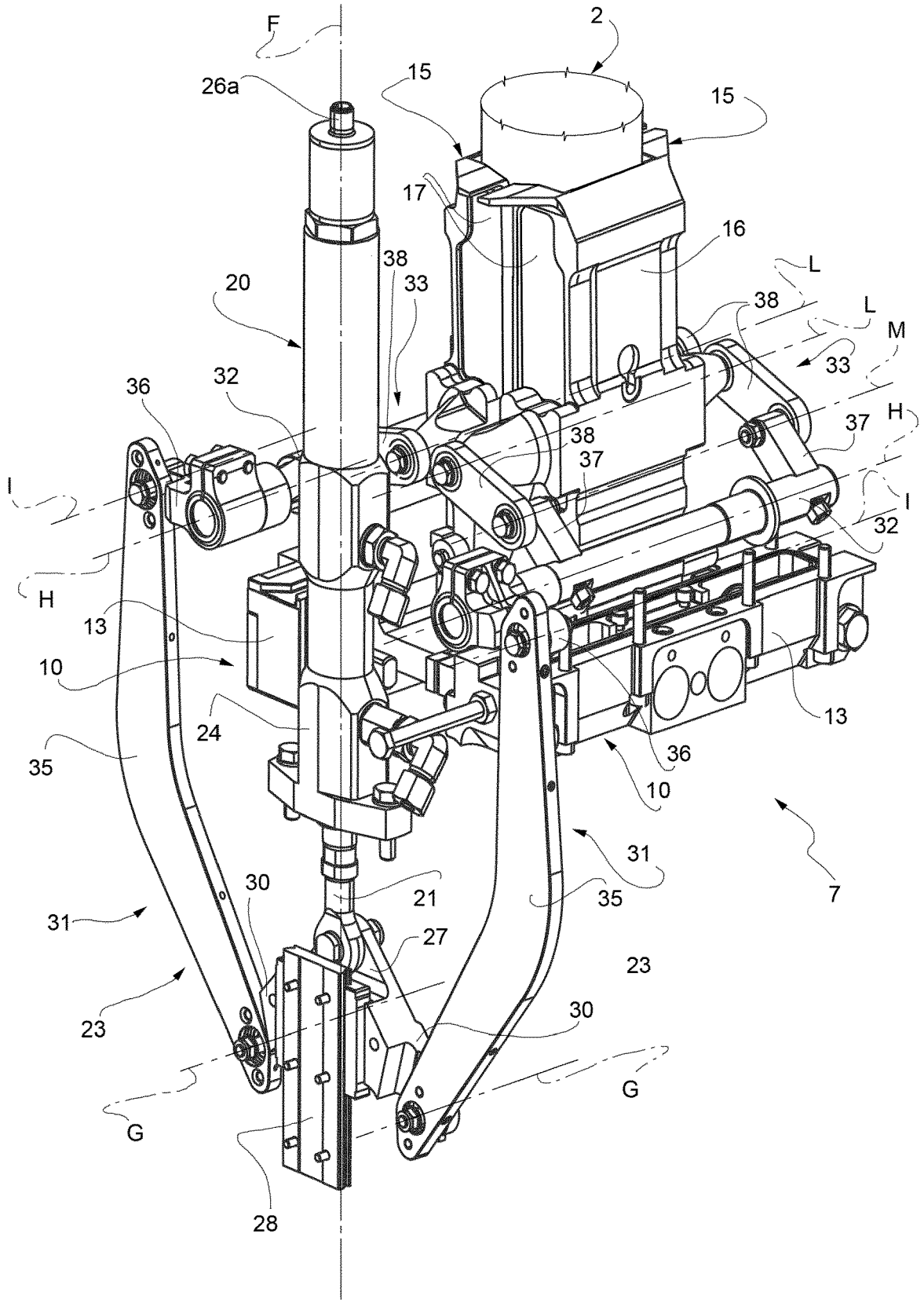
FIGS. 6 to 8 show different larger-scale perspective views of a part of the forming assembly of FIG. 2.
Figure 7:
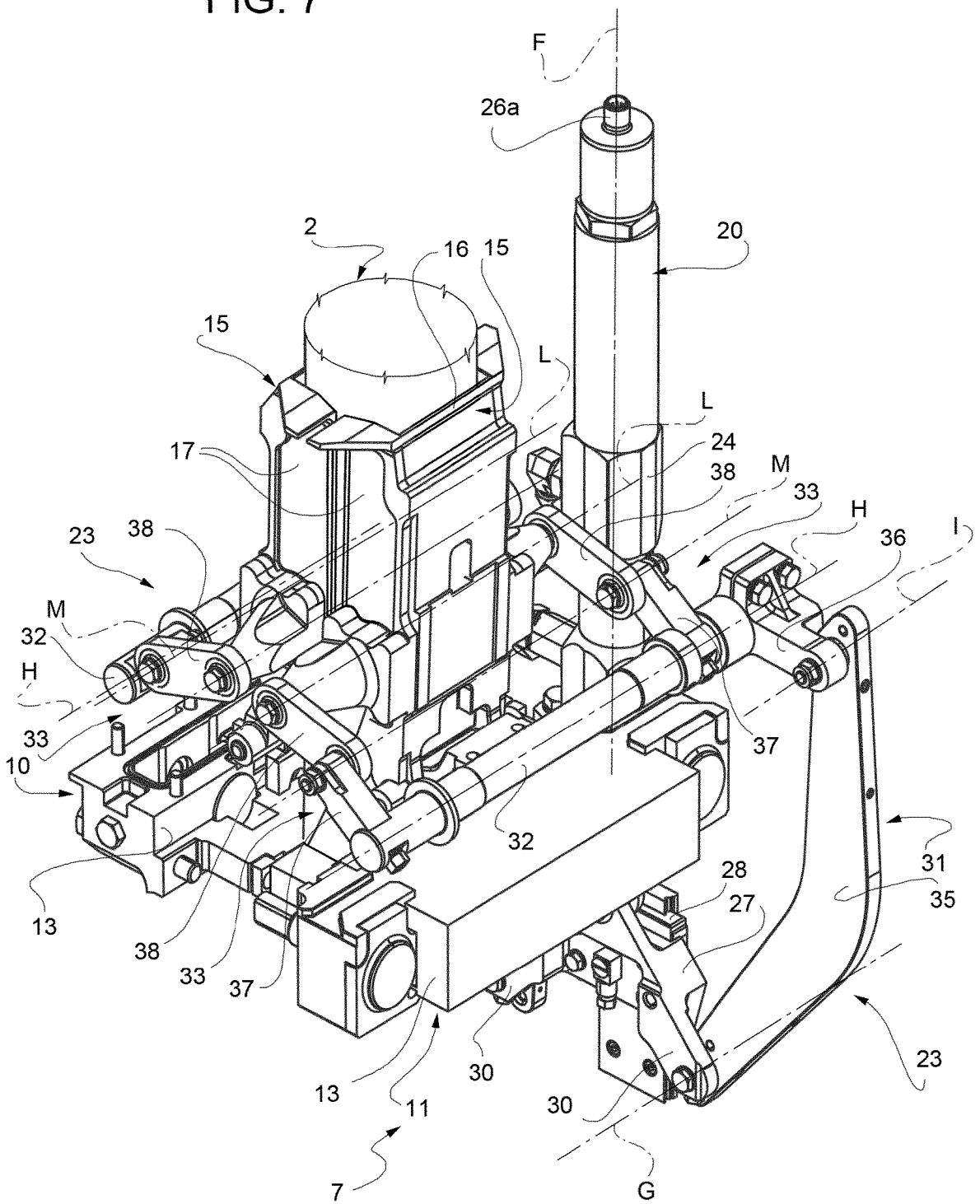
Figure 8:
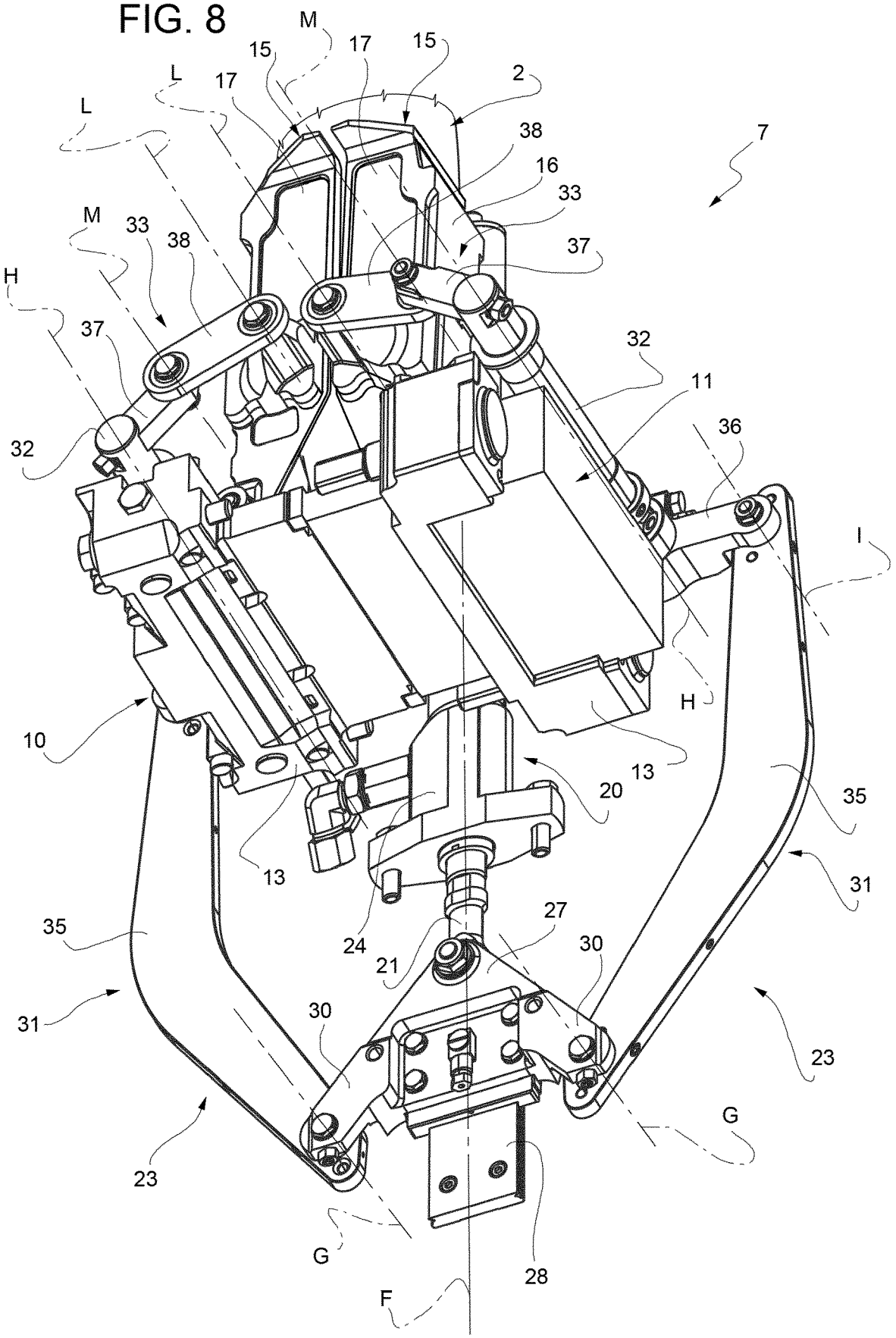

In this specific case, control system 22 comprises:

- a fluidic circuit **22*a* having a flow control valve 25—known per se and only schematically shown in FIGS. 3 to 5, for instance of proportional type—connected to fluidic actuator 20**; and
- a control unit 26 configured to drive the valve 25 and to control the position of mover 21 through a sensor **26*a* placed on actuator 20**.

As visible in FIGS. 2 to 8, the free end portion of mover 21 is secured to a slide member 27, running along axis F on a guide member 28 in turn carried by slide 9; in particular, slide member 27 has opposite side portions 30 hinged to respective linkages 23 about respective hinge axes G.

Each linkage 23 comprises:

- a converting mechanism 31 connecting, in an articulated manner, mover 21 to a shaft 32 mounted to the arm 13 of the respective jaw 10, 11 in an axially fixed position and in a rotatable manner about an axis H parallel to axes B, C, D, E and hinge axis G; and
- one or two toggle mechanisms 33 connecting the shaft 32 to the respective forming member 15 and driven by the shaft 32 itself.

Each converting mechanism 31 is configured to transform the linear movement of mover 21 along axis F into a rotation of the respective shaft 32 about its axis H. In particular, each converting mechanism 31 comprises a first lever 35, extending on one respective side of axis F and articulated to slide member 27 about respective hinge axis G, and a second lever 36, angularly coupled to the respective shaft 32 and connected to the lever 35 about another hinge axis I, parallel to hinge axis G.

In the preferred example shown, each forming member 15 is connected to the respective shaft 32 by two toggle mechanisms 33.

Each toggle mechanism 33 comprises one driving lever 37, angularly coupled to the respective shaft 32 and radially projecting from the shaft 32 itself, and one connecting lever 38, connected, at one end portion, to the respective forming member 15 about a respective hinge axis L parallel to hinge axes G, I and, at the opposite end portion, to the lever 37 about a respective hinge axis M, parallel to hinge axes G, I and L.

In particular, in the example shown, the toggle mechanisms 33 of each linkage 23 connect the respective shaft 32 to the two lateral walls 17 of the respective forming member 15.

As clearly shown in FIG. 5, in the closed position of jaws 10, 11 and in the second operating position of forming members 15, hinge axes G and M of each linkage 23 are vertically aligned, i.e. are aligned to one another parallel to axes A and F. This particular condition guarantees that no movement may occur between each forming member 15 and the respective levers 38 during the definition of the correct volume of the package being formed; as a matter of fact, by having this alignment, no relative motion may occur between the levers 38 of the toggle mechanisms 33 of each linkage 23 and the respective lever 35.

In use, tube 2, filled with the liquid food product by pipe 4, is fed along path A, and forming assemblies 7, 7', operating a half-period out of phase, move up and down along respective guides 8, 8'.

More specifically, as forming assemblies 7, 7' move up and down, jaws 10, 11 are moved in a known manner between the closed position (FIGS. 1, 2 and 4 to 8), in which they heat seal cross sections of tube 2, and the open position (FIG. 3), in which they are detached from tube 2.

More specifically, forming assembly 7 moves up, with jaws 10, 11 open, at the same time as forming assembly 7' moves down, with jaws 10, 11 closed, so that arms 13 and forming members 15 of forming assembly 7' pass between, and so avoid interfering with, arms 13 and forming members 15 of forming assembly 7.

As forming assemblies 7, 7' operate, forming members 15 perform their work cycles under the control of respective actuators 20 and control systems 22.

For the sake of clarity, the following description is limited to the operation of forming assembly 7 only; it is however clear that exactly the same features described hereafter apply to the other forming assembly 7' simply operating a half-period out of phase.

Once jaws 10, 11 are in the closed position on the tube 2 (FIG. 4), mover 21 of actuator 20 slides upwards along axis F so as to move, through linkages 23, forming members 15 from the first operating position (FIG. 4) to the second operating position (FIG. 5). In particular, the upward displacement of mover 21 along axis F produces a corresponding translation of slide member 27 along guide member 28 and consequent opposite rotations of both shafts 32 towards one another (clockwise rotation for the shaft 32 on the left in FIG. 4 and anticlockwise rotation for the shaft 32 on the right) about their respective axes H through the action of respective levers 35 and 36.

The rotation of each shaft 32 produces a corresponding rotation of respective levers 37 with a consequent "extension" of toggle mechanisms 33 from the substantially "right angle" configuration of FIG. 4 to the almost "linear" configuration of FIG. 5. This movement produces the rotation of forming members 15 to the second operating position (FIGS. 2 and 5 to 8), in which the forming members 15 mate with one another and cooperate with the tube 2 to define the volume and shape of the package being formed above the cross section of the tube 2 itself gripped by the jaws 10, 11 of the forming assembly 7.

Actuator 20 holds forming members 15 in the second operating condition during the downward movement of the slide 9 along the respective guide 8.

During this step, the sealing device is activated, and forming members 15 control the volume and shape of the package being formed.

Once sealing is completed, jaws 10, 11 begin opening by rotating about respective axes B, C, while actuator 20 is kept in the configuration in which maintains the forming members 15 in the second operating position. The parting of jaws 10 11 withdraws forming members 15 from tube 2.

At this point the forming assembly 7 returns to the initial condition by movement of the slide 9 upwards along the respective guide 8; this return stroke is carried out with the jaws 10, 11 in the open position; the forming members 15 are instead gradually reopened during the return stroke, the only constraint being that such forming members 15 reach again the first operating position at the end of the return stroke. In this way, it is possible to reduce the dynamic stresses on the packaging unit 1.

As a possible alternative, forming members 15 may be kept in the second operating position along the most part of the return stroke so as to minimize inertial forces and then gradually moved to the first operating position at the end of such stroke.

The advantages of packaging unit 1 according to the present invention will be clear from the foregoing description.

In particular, thanks to the fact that mover 21 is connected to forming members 15 through linkages 23, the position of the forming members 15 themselves is always controlled by actuator 20 and valve 25 whatever is the position of jaws 10, 11. This permits to gradually move the forming members 15 from the second operating position to the first operating position during the return stroke, i.e. even in a condition in which the jaws 10, 11 are already in the open position.

As previously mentioned, the forming members 15 may be kept in the second operating position along most part of the return stroke and moved into the first operating position only at the end of the return stroke so as to minimize the inertial forces acting on the forming assemblies 7, 7'.

In general, the new solution permits to control the position of the forming members 15 independently of the position of the respective jaws 10, 11 in a very flexible way, so as to minimize possible dynamic stresses on the packaging unit 1 and on tube 2. In this way, work cycle profile of the forming members 15 may be easily and immediately changed with no impact on the work cycle profile of the respective jaws 10, 11. This enables to introduce a powerful trouble shooting tool for addressing possible issues on the field.

For instance, the movement of forming members 15 can be controlled to avoid possible undesired pinching or local tears of the packaging material: this can be achieved by varying the motion profile of the forming members 15, i.e.

the time in which they pass from the first operating position to the second operating position, and vice versa, in certain critical conditions.

More in general, the new solution allows to avoid any mechanical impact of moving parts and to reduce vibrations with a consequent increasing in life-time of the various components of the packaging unit 1 and smoother control.

It is also possible to maintain the forming members 15 in the first operating position along the entire work cycle when the tube 2 is empty and/or in any transitory filling step; in this way, possible undesired stresses on the tube 2 can be avoided as well as possible rotations thereof can be mitigated.

By varying the motion profiles of forming members 15, it is possible to keep constant the weight of the packages to be formed in case the output rate of the packaging unit 1 changes, for instance during any transitory step.

In addition, the packaging unit 1 may be provided with a scale capable of monitoring in line the weight of the packages being formed and of generating a feedback signal, which may be used to modify, if necessary, the motion profile of the forming members 15 in order to correct the weight.

Last but not least, the movement of the forming members 15 can be performed in an easier and slower way with respect to what is required in the solutions disclosed in EP-A-1795447.

Clearly, changes may be made to packaging unit 1 as described herein without, however, departing from the scope of protection as defined in the accompanying claims.

The invention claimed is:

1. A packaging unit for producing sealed packages containing a pourable food product from a tube of packaging material, the packaging unit comprising:

at least two jaws configured to advance the tube along a first axis, arranged on opposite sides of the first axis and movable between (a) a closed position, in which the jaws grip and seal the tube of packaging material at a cross section of the tube, and (b) an open position, in which the jaws are detached from the tube;

at least two forming members arranged on opposite sides of the first axis and supported by the respective jaws in a movable manner between (a) a first operating position, in which, in relation to the open position of the jaws, the forming members are a maximum distance from one another, and (b) a second operating position, in which, in relation to the closed position of the jaws, the forming members mate with one another and cooperate with the tube to define the volume of the package being formed between a top and a bottom cross section;

an actuator configured to move the forming members between the first operating position and the second operating position, wherein the actuator comprises at least one mover unit connected to at least one of the respective forming members in at least one of the open or closed positions of the jaws and selectively activated to move the respective forming member in opposite directions away from the first axis; and a control unit to control the mover unit;

wherein the mover unit is configured to have a linear movement along a second axis parallel to the first axis, wherein the forming members have respective rotary movements towards and away from one another about respective third axes orthogonal to the first axis and the second axis, and wherein at least one linkage transforms the linear movement of the mover unit along the second axis into a rotary movement of the respective forming member about the respective third axis, wherein the actuator comprises one single fluidic actuator coaxial to the second axis and including a housing, wherein the mover unit is coupled to the housing in a sliding manner; and wherein the control unit comprises a flow control valve, connected to the fluidic actuator, and a control device driving the valve, wherein each jaw is hinged to a common supporting body, and the forming members are hinged to the respective jaws about the respective third axes.

2. The packaging unit as claimed in claim 1, wherein the mover unit produces the movement of the respective forming member without a spring member.

3. The packaging unit as claimed in claim 1, wherein the mover unit is connected to the respective forming member through the linkage.

4. The packaging unit as claimed in claim 3, wherein the mover unit is connected to the other of the at least one of the respective forming members by an additional linkage both linkages extending on opposite sides of the second axis.

5. The packaging unit as claimed in claim 4, wherein the mover unit is secured to a slide member running along a guide member carried by the supporting body, and wherein the slide member has opposite side portions hinged to the linkages about respective first hinge axes.

6. The packaging unit as claimed in claim 1, wherein the linkage comprises a converting unit that connects, in an articulated manner, the mover unit to a shaft having a fourth axis parallel to the third axis, wherein the converting unit is configured to transform the linear movement of the mover unit along the second axis into a rotation of the shaft about the fourth axis, and wherein the linkage further comprises at least one toggle mechanism connecting the shaft to the respective forming member and driven by the shaft.

7. The packaging unit as claimed in claim 6, wherein the converting unit comprises a first lever, extending on one side of the second axis and articulated to the mover unit about a first hinge axis parallel to the third axis and the fourth axis, and a second lever, angularly coupled to the shaft and connected to the first lever about a second hinge axis, parallel to the first hinge axis.

8. The packaging unit as claimed in claim 7, wherein each toggle mechanism comprises at least one driving lever, angularly coupled to the shaft and radially projecting from the shaft, and at least one connecting lever, connected, on one end portion, to the respective forming member and, on an opposite end portion, to the driving lever about a third hinge axis, parallel to the first hinge axis and the second hinge axis.

9. The packaging unit as claimed in claim 8, wherein, in the closed position of the jaws and in the second operating position of the forming members, the first hinge axis and the third hinge axis of the linkage are aligned to one another and parallel to the first axis and the second axis.

10. The packaging unit as claimed in claim 1, wherein the actuator is carried by the supporting body.

11. The packaging unit as claimed in claim 1, wherein the supporting body is coupled in a sliding manner along a guide parallel to the first axis and the second axis.

12. The packaging unit as claimed in claim 1, wherein the at least two jaws correspond to a first pair of jaws and the at least two forming members correspond to a first pair of forming members, wherein the packaging unit further comprises a second pair of jaws and a second pair of forming members, wherein the two pairs of jaws are located on opposite sides of the first axis and interact alternately with the tube, and each pair of jaws carries a pair of forming members.

* * * * *